US009941578B2

(12) United States Patent
Gardner et al.

(10) Patent No.: US 9,941,578 B2
(45) Date of Patent: Apr. 10, 2018

(54) MINIMAL REACTANCE VEHICULAR ANTENNA (MRVA)

(71) Applicant: SPAWAR Systems Center Pacific, San Diego, CA (US)

(72) Inventors: Chad Michael Gardner, Charleston, SC (US); Ken Allen Crawley, Cataldo, ID (US)

(73) Assignee: The United States of America as represnted by Secretary of the Navy, Washington, DC (US)

( * ) Notice: Subject to any disclaimer, the term of this patent is extended or adjusted under 35 U.S.C. 154(b) by 201 days.

(21) Appl. No.: 14/601,059

(22) Filed: Jan. 20, 2015

(65) Prior Publication Data

US 2016/0211573 A1 Jul. 21, 2016

(51) Int. Cl.

*H01Q 1/32* (2006.01)
*H01Q 1/48* (2006.01)
*H01Q 9/36* (2006.01)

(52) U.S. Cl.

CPC ..... *H01Q 1/3275* (2013.01); *H01Q 1/48* (2013.01); *H01Q 9/36* (2013.01)

(58) Field of Classification Search

CPC ..... H01Q 1/3275; H01Q 1/48; H01Q 9/36; H01Q 1/32

USPC ..... 343/700 MS, 711, 712, 713, 829, 846

See application file for complete search history.

(56) References Cited

U.S. PATENT DOCUMENTS 2,476,407 A * 7/1949 Eriksen ..... H01Q 1/1214 174/151
2,611,865 A * 9/1952 Alford ..... H01Q 13/18 343/769
2,920,323 A * 1/1960 Dunson ..... H03H 7/38 333/32
4,115,783 A * 9/1978 Reggia ..... H01Q 1/08 343/792
4,821,040 A * 4/1989 Johnson ..... H01Q 1/3275 343/700 MS
5,181,044 A 1/1993 Matsumoto et al.
5,796,369 A 8/1998 Henf
6,795,023 B2 9/2004 Chen (Continued)

OTHER PUBLICATIONS

Kevin Kuo et al.; Optimization of a Microstrip Matching Circuit at Two Frequencies Using Taguchi's Method; 28th Annual Review of Progress in Applied Computational Electromagnetics; Apr. 10-14, 2012.

(Continued)

*Primary Examiner* — Tho G Phan
(74) *Attorney, Agent, or Firm* — SPAWAR Systems Center Atlantic; Kyle Eppele; J. Eric Anderson

(57) ABSTRACT

An antenna comprising: a hollow conductive chamber having an upper end and a lower end, wherein the lower end is open; a shorting strap electrically connected to the upper end; a conductive center member running through the chamber and electrically connected to the shorting strap; a conductive ground plane having a top surface and a bottom surface, wherein the top surface is separated from the lower end of the chamber by a gap; and a first solid insulator connected to the chamber and the top surface of the ground plane such that the first insulator fills the gap and fills the lower end and an interior portion of the chamber.

19 Claims, 9 Drawing Sheets

(56) References Cited

U.S. PATENT DOCUMENTS

| | | | | |
|---|---|---|---|---|
| 7,084,835 | B1 | 8/2006 | McCormick et al. | |
| 2003/0122719 | A1* | 7/2003 | Nilsson ..... | H01Q 1/3275 343/711 |

OTHER PUBLICATIONS

Wei-Chung Weng et al.; Linear Antenna Array Synthesis Using Taguchi's Method: A Novel Optimization Technique in Electromagnetics; IEEE Transactions on Antennas and Propagation, vol. 55, No. 3, Mar. 2007.

C. M. Gardner; A Conformal Taguchi Optimized E-Patch Antenna; A Thesis, Michigan State University; 2010.

* cited by examiner

MINIMAL REACTANCE VEHICULAR ANTENNA (MRVA)

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Atlantic, Code 72000; voice (843) 218-3495; ssc_lant_t2@navy.mil. Reference Navy Case Number 103302.

BACKGROUND OF THE INVENTION

The invention described herein relates to the field of communications antennas. Current antennas have a number of limitations and shortcomings. There is a need for an improved antenna.

SUMMARY

Disclosed herein is an antenna comprising: a hollow conductive chamber, a shorting strap, a conductive center member, a conductive ground plane, and a first solid insulator. The conductive chamber has an upper end and a lower end, and the lower end is open. The shorting strap is electrically connected to the upper end. The conductive center member runs through the chamber and is electrically connected to the shorting strap. The conductive ground plane has a top surface and a bottom surface, and the top surface is separated from the lower end of the chamber by a gap. The first solid insulator is connected to the chamber and the top surface of the ground plane such that the first insulator fills the gap and fills the lower end and an interior portion of the chamber.

An embodiment of the antenna disclosed herein may be described as an antenna comprising a chamber, a center member, a ground plane, a first insulator, and a second insulator. The chamber is hollow, conductive, and cylindrical and has an upper end, a lower end, and a diameter d. The lower end of the chamber is open. The center member is conductive and is positioned along an axis of the chamber and is electrically connected to the upper end of the chamber. The ground plane in this embodiment is circular and conductive and has a top surface and a bottom surface and a diameter of approximately 2d. The ground plane is electrically insulated from the chamber and the center member. The first insulator is solid and has a cylindrical shape and a diameter of approximately d. The first insulator is positioned partially within, and connected to, the chamber such that it fills an interior portion of the chamber. The first insulator is connected to the top surface of the ground plane such that the top surface is separated from the lower end of the chamber by a gap. The second insulator is solid and has a cylindrical shape and a diameter of approximately 2d. The second insulator is connected to the bottom surface of the ground plane.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

Disclosed herein are various embodiments of an antenna 10 having an improved design. The antenna 10 below may be described generally herein, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
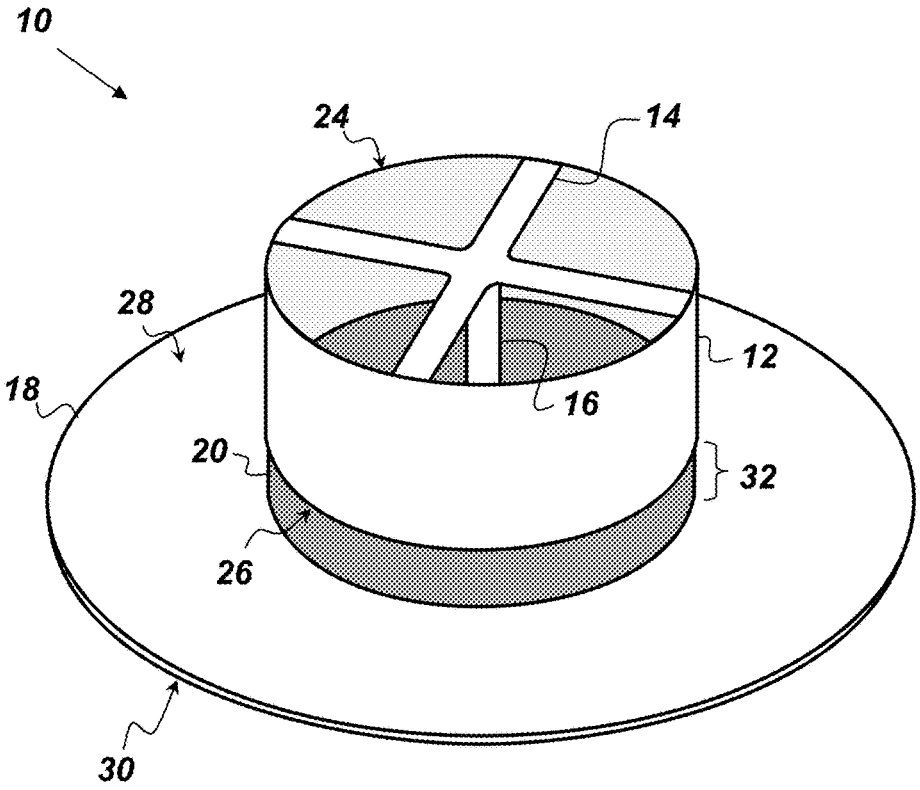
FIG. 1 is an oblique view of an embodiment of an antenna.

FIG. 1 is an oblique view illustration of an embodiment of the antenna 10 that comprises, consists of, or consists essentially of a chamber 12, a shorting strap 14, a center member 16, a ground plane 18, and a first insulator 20. The chamber 12 is hollow and conductive and has an upper end 24 and a lower end 26. The lower end 26 of the chamber 12 is open. In other words, the lower end 26 is un-enclosed by conductive material. Rather, the lower end 26 may be filled with the first insulator 20 such as is shown in FIG. 1. The shorting strap 14 may be electrically connected to the upper end 24. The center member 16 is conductive and is electrically connected to the shorting strap 14. The ground plane 18 is conductive and has a top surface 28 and a bottom surface 30. The top surface 28 is separated from the lower end 26 of the chamber 12 by a gap 32. The first insulator 20 is made of a solid material and is connected to the chamber 12 and the top surface 28 of the ground plane 18 such that the first insulator 20 fills the gap 32 and fills the lower end 26 and an interior portion 34 of the chamber 12. (The interior portion 34 is not labeled in FIG. 1, but is identified in FIG. 4A.) The interior portion 34 is the volume of the chamber 12 occupied by the first insulator 20.

The chamber 12 may be made of any conductive material and may be any desired size and/or shape. For example, the chamber 12 may be made of, but is not limited to, the following materials: brass, copper, aluminum, and steel. The size of the chamber 12 and the interior portion 34 occupied by the first insulator 20 may be designed such that the antenna 10 is non-resonant at 50 ohms. The entire antenna 10 may be coated in a thin layer of dielectric and/or encased with a radome that has an attenuation of 0.2 dB or less to protect the antenna 10 against performance degradation to due to exposure to the environment and vibrations.

The shorting strap 14 may be any conductor that connects the center member 16 to the upper end 24 of the chamber 12. The shorting strap 14 may be any desired size and shape. For example, the shorting strap 14 may consist of a single arm (e.g., FIG. 9A) or the shorting strap may be disk-shaped and completely cover the upper end 24 of the chamber 12 (e.g., FIG. 9D).

Figure 4A:
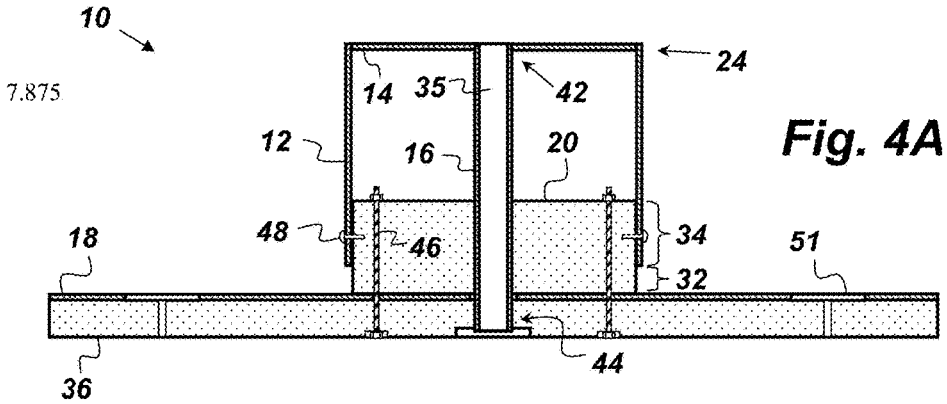
FIG. 4A is a cut-away, side view illustration of an embodiment of an antenna.

The center member 16 may be any conductor capable of electrically coupling electromagnetic energy from a feed to the shorting strap 14. For example, the center member 16 may be a copper pipe with a distal end electrically connected to the shorting strap 14 and a proximal end electrically connected to a cable. Other suitable examples of the center member 16 include, but are not limited to, a flexible wire such as the center conductor of a coaxial cable, square tubing, a Litz wire, and hardline cable. The center member 16 may be solid or hollow, braided or smooth, and flexible or rigid. In embodiments of the antenna 10 where the center member 16 is hollow, such as is shown in FIG. 4A, the center void may be filled with foam, a gas dielectric, dry air, and/or the like.

Figure 7A:
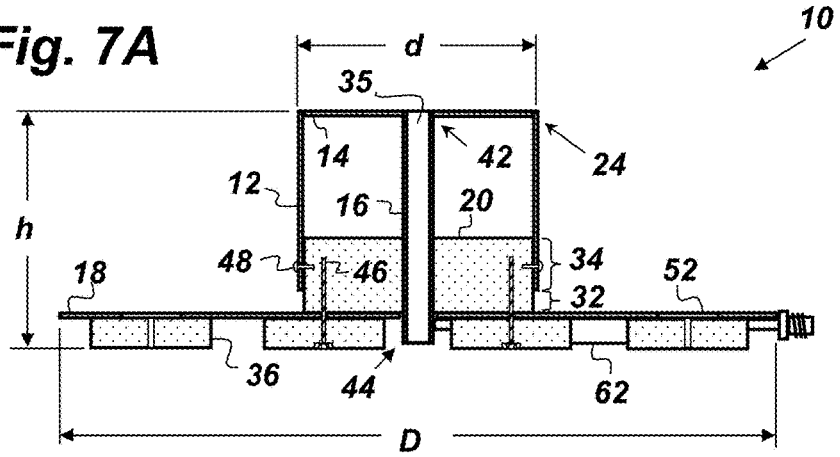
FIG. 7A is a cut-away, side view illustration of an embodiment of an antenna.

The ground plane 18 may be any conductive material and any desired size and/or shape. The ground plane 18 and the chamber 12 may be made of the same material or they may each be made of a different material. FIGS. 9A-9D provide several illustrations of different embodiments of the antenna 10, each with a different ground plane 18. In an embodiment of the antenna 10 where the ground plane 18 is disk-shaped, such as is illustrated in FIG. 7A, a ratio of a diameter D of the ground plane 18 to an overall height h of the antenna 10 (i.e., D:h) and a ratio of the ground plane diameter D to a diameter d of the conductive chamber (i.e., D:d) may be approximately 3:1.

The first insulator 20 may be any solid material. Suitable examples of the first insulator 20 include, but are not limited to, closed-cell foam, polyoxymethylene (such as Delrin® produced by E. I. du Pont de Nemours and Company or DuPont™), acetal, polytetrafluoroethylene (such as Teflon® produced by DuPont™), crystallized honey, and polyetherimide (such as ULTEM® produced by Saudi Basic Industries Corporation or SABIC). The first insulator 20 may have a dielectric constant greater than 1 and a breakdown voltage that is at least as high as moisture-saturated air. The first insulator 20 may be physically connected to the chamber 12 with adhesives and/or with fasteners. For example, the first insulator 20 may have a relative permittivity ($\varepsilon_r$) of about 2.24 and a break down voltage of about 830 V/millimeter of thickness. A part of the first insulator 20 must fit within the interior portion 34 of the chamber 12. The first insulator 20 may also be physically connected to the ground plane 18 with adhesives and/or with fasteners. The fasteners may be conductive or nonconductive. For example, in an embodiment, the fasteners may be screws. In another embodiment, the fasteners may be ULTEM® plastic threaded rods, and nuts such as is depicted in FIG. 4A. In the embodiment of the antenna 10 where fasteners are used to connect the first insulator 20 to the ground plane 18, the fasteners may be, but are not limited to, screws or through-bolts. The first insulator 20 may be perforated, and/or sized, for example to allow water to drain out of the chamber 12.

Figure 4B:
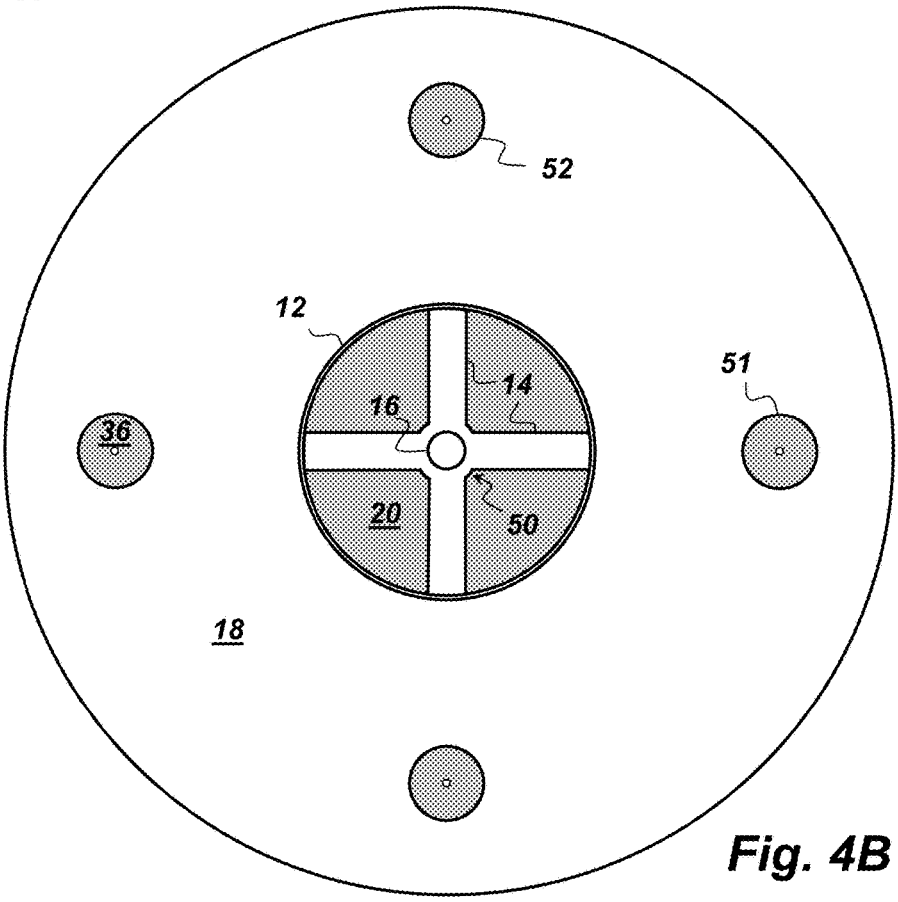
FIG. 4B is a top view of an embodiment of an antenna.

The gap 32 may be as tall as the center member 16 is wide. The size of the gap 32 may be designed based on the desired performance characteristics of the antenna 10. For example, in an embodiment of the antenna 10 designed to operate in the very high frequency (VHF) and ultra-high frequency (UHF) regions (such as is shown in FIGS. 4A and 4B), the gap 32 may be 2.54 cm (1 inch). Regarding the interior portion 34, in one example embodiment, the size of the interior portion 34 may be just a few millimeters in height (e.g., to allow a sufficient amount of insulator 20 within the chamber 12 to allow the chamber 12 to be screwed to the first insulator 20). As a specific example, the interior portion 34 may be, but is not limited to, 2.54 cm (1 inch). In another example embodiment, the interior portion 34 may equal the entire internal volume of the chamber 12 such that the first insulator 20 fills the gap 32 and the entire internal volume of the chamber 12 up to the shorting strap 14.

Figure 2:
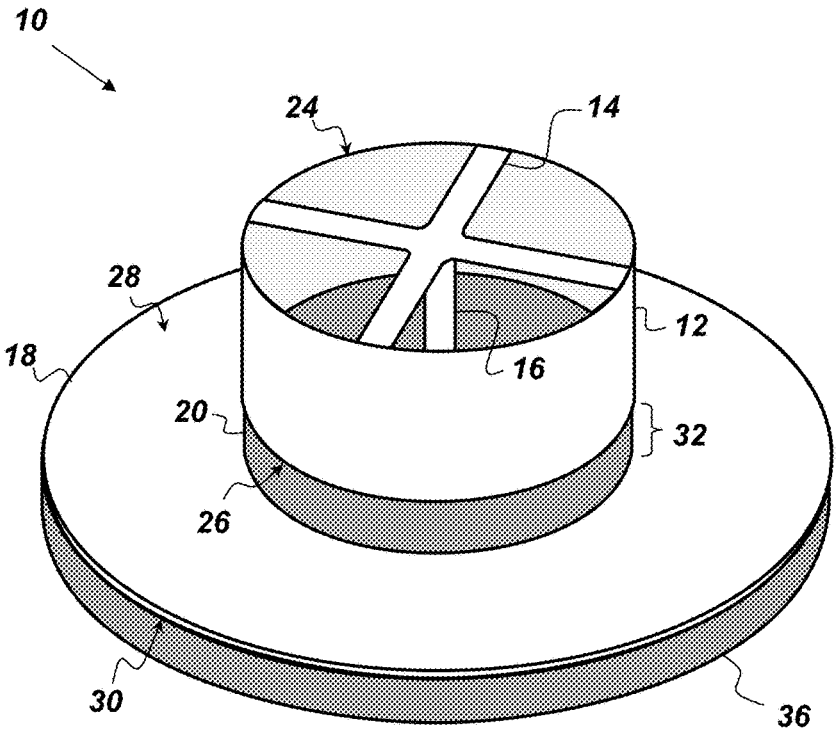
FIG. 2 is an oblique view of an embodiment of an antenna.

FIG. 2 is an oblique view illustration of an embodiment of the antenna 10 further comprising a second insulator 36 that is made of a solid dielectric material and is connected to the bottom surface 30 of the ground plane 18. The second insulator 36 may be any solid material having a dielectric constant greater than 1 and a breakdown voltage that is at least as high as moisture-saturated air. Suitable examples of the second insulator 36 include, but are not limited to, polyoxymethylene (such as Delrin® produced by E. I. du Pont de Nemours and Company or DuPont™), acetal, polytetrafluoroethylene (such as Teflon® produced by DuPont™), and polyetherimide (such as ULTEM® produced by Saudi Basic Industries Corporation or SABIC). The second insulator 36 may be a solid piece, or it may comprise multiple components (See, for example, FIG. 7B). The second insulator 36 may be shaped so as to conform to the roof 38.

Figure 3:
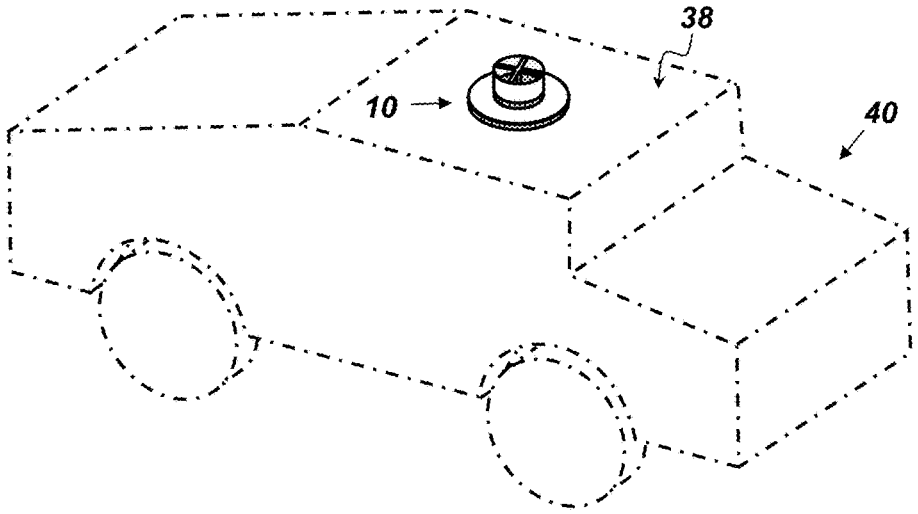
FIG. 3 is an oblique view of an embodiment of an antenna on a vehicle.

FIG. 3 is an illustration showing the embodiment of the antenna 10 depicted in FIG. 2 mounted to a roof 38 of a vehicle 40. In this embodiment, the second solid insulator 36 is connected to the vehicle roof 38 such that the ground plane 18 is electrically insulated from the roof 38. It is to be understood that the antenna 10 may be mounted to any given support surface in any desired orientation, and that the second insulator 36 may serve to electrically isolate the antenna 10 from the given support surface.

FIGS. 4A and 4B are a cut-away, side view illustration and a top view respectively of an embodiment of the antenna 10. In the embodiment illustrated in FIGS. 4A and 4B, the chamber 12 is a hollow brass cylinder, 30.48 centimeters (12 inches) in diameter, 15.24 cm (6 inches) in height, and having a wall thickness of 0.081 cm (0.032 inches). The ground plane 18 is a brass disk having a diameter of 60.96 cm (24 inches) and a thickness of 0.081 cm (0.032 inches). In this embodiment, the shorting strap 14 comprises brass arms electrically connecting the center member 16 to the upper end 24 of the chamber 12, each arm being 2.54 cm (1 inch) wide and 0.081 cm (0.032 inches) thick. Inner fillets 50 of the shorting strap 14 are based on a 4.45 cm (1.75 inch) diameter circle. The center member 16, in this embodiment, is a schedule L or schedule K copper pipe having a diameter of 2.54 cm (1 inch) and a length of 20 cm (7.875 inches). In this embodiment, the distal end 42 of the center member 16 is electrically connected to the shorting strap 14 with silver solder. The center member 16, in this embodiment, is inserted through the first and second insulators 20 and 36 such that the proximal end 44 of the center member 16 stops short of the bottom surface 30 of the ground plane 18 by 6.35 mm (0.25 inches) in order to provide an attachment point for a center conductor of a coaxial cable.

Still referring to the embodiment of the antenna 10 shown in FIGS. 4A and 4B, the first insulator 20 is a solid cylinder of ULTEM®-1000 material, having a height of 6.35 cm (2.5 inches) and an approximate diameter dimension of 30.48 cm (12 inches) such that the first insulator 20 fits within the chamber 12. In this embodiment, the first insulator 20 has a 2.86 cm (1.125 inches) diameter hole bored through its center to accommodate the center member 16. The first insulator 20, the ground plane 18, and the second insulator 36, in this embodiment, are securely held together by ULTEM® plastic through-bolts 46. Also in this embodiment, the chamber 12 is secured to the first insulator 20 by ULTEM® plastic screws 48. The second insulator 36 shown in FIG. 4A is a solid cylinder of Delrin® material, having a height of 2.54 cm (1 inch) and a diameter of 60.96 cm (24 inches). A channel (not shown) may be cut in lower insulator 36 to accommodate a coax cable connected to the center member 16. Holes 51 in the ground plane 18 may be used to facilitate securing the antenna 10 to the roof 38. For example, studs on the roof 38 may extend through the second insulator 36 and protrude through the ground plane 18, through the holes 51, where nuts may be screwed on to secure the second insulator 36, and thus the antenna 10, to the roof 38.

Figure 5:
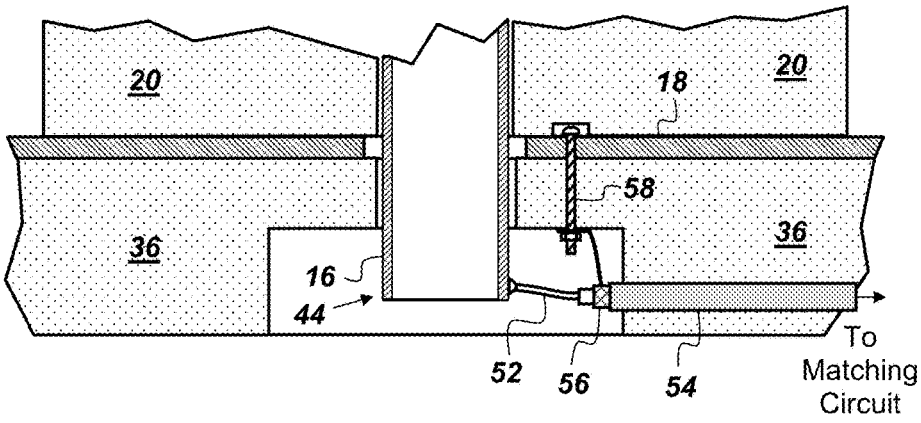
FIG. 5 is a cut-away, side view illustration of a section of an antenna.

FIG. 5 is a close-up, cross-sectional, side-view illustration of an electrical connection point of the embodiment of the antenna 10 shown in FIGS. 3 and 4A-4B. In that embodiment, the proximal end 44 of the center member 16 is electrically connected to a center conductor 52 of a coaxial cable 54, and the braided shield 56 of the coaxial cable 54 is electrically connected to the ground plane 18 by a brass screw 58. A suitable example of the coaxial cable 54 is a Heliax® FSJ1-50A radio frequency (RF) cable. The cable 54 may be connected to a matching circuit (not shown). Alternatively, the matching circuit may be connected directly to the proximal end of the center member 16 without the need for the cable 54, such as is shown in FIG. 8. Distributed ferrite bead isolators may be used on the coaxial cables of other nearby antennas (e.g., antennas on the same roof 38) to reduce RF reradiating from the coaxial shields.

The greatest factor in RF cosite interference may be regarded as close proximity of radiating antennas. The RF cosite interference is measured as the |S21| between antennas. |S21| is the magnitude of the scattering parameter S21 which is a measure of power received between transmitting and receiving antennas. The |S21| can be calculated approximately, with the well-known Friis equation:

$$\frac{P_r}{P_t} = G_t G_r \left(\frac{\lambda}{4\pi R}\right)^2 \qquad \text{Eq. 1}$$

Here $P_r$ is the power received at a receiving antenna, $P_t$ is the power transmitted of a transmitting antenna, lambda ($\lambda$) is wavelength, R is distance of separation of the transmitting and receiving antennas, $G_t$ is the gain of the transmitting antenna, and $G_r$ is the gain of the receiving antenna. Note, that this is assuming the antennas are orientated so that maximum radiation is occurring between them, and that the antennas are well matched (VSWR=1) and are in the Franhoffer zone. It is clear by the above equation that the farther a receiving antenna is from the transmitting antenna the received power is decreased at $1/R^2$ distance. However, when antennas are in the near-field or Frensel zone, the equation for received power is approximately $1/R^4$ distance. This means that when antennas are in the Frensel zone there is even greater RF cosite interference than when the antennas are in the Franhoffer zone.

By examining either the standard Friis equation or Frensel zone equations the gain of the receiving and transmitting antennas is a determiner of power received at a receiving antenna. When utilizing circuit filtering, $P_r$ and $P_t$ are the dominating parameters that can act to lessen coupling between un-movable cosited antennas. However, this only prevents out-of-band interference on the victim antenna. When there is in-band interference and the distance between antennas is fixed, the last parameter to explore in lessening RF cosite interference is the gain of the antennas.

When the |S21| is great enough at the receiving antenna, the radio the antenna is connected to is desensitized. This desensitization means that incoming signals from transmitting antennas not located on a cosited antenna platform will not be detected by the radio. The antenna 10 may be used as a low gain broadband antenna by operators of radio and video equipment in military, commercial, private and amateur radio sectors to transmit, receive or transmit information from various, limited-real-estate platforms such as on vehicles or building roof-tops.

An embodiment of the antenna 10 may be used to transmit or receive in the VHF and UHF regions. Antenna 10 may exhibit broadband characteristics in the VHF band by use of a suitable RF matching circuit. The radiation pattern and associated radiation resistance of the antenna 10 is determined by the current density that runs on the surface of the volumetric space that the antenna takes up. When current flows in an antenna it creates a magnetic field, H, surrounding the conductor or coil. This same current flow also creates an electric field, difference of potential, or voltage, E, between the emitter and counterpoise or ground plane. The H and E fields interact or "cross" each other creating electro(E)-magnetic(H) radiation. Maxwell's equations indicate that the electromagnetic radiation resulting from E times H will be proportional to the smaller of these two quantities that are inherently balanced.

The radiation resistance of the antenna 10 can be affected with matching circuitry to bring the impedance of the MRVA closer to that of a 50 ohm system. Taguchi's method of optimization, such as is disclosed in C. M. Gardner's master's thesis "A Conformal Taguchi Optimized E-Patch Antenna", Michigan State University, East Lansing, Mich., August 2010, which thesis is incorporated by reference herein in its entirety, may be applied to RF circuit matching topologies to determine a suitable broadband match. Without the matching circuit, a radio connected to the antenna 10 will not be able to transfer power to, or extract power from, the antenna 10 due to impedance mismatch. According to circuit theory, maximum power transfer can only occur when the impedances of the generator system and load are the same. Taguchi's Method of optimization was developed by Dr. Genchi Taguchi as a way of using statistics to design and improve quality in manufactured goods. It is a fractional factorial approach to optimization. Instead of exhausting all possible combinations of parameters, a smaller number of the parameter combinations are used to sample the entire exhaustive set. This fraction of possibilities achieves a comparable outcome to the full factorial approach. In order to use Taguchi's Method the concept of Orthogonal Arrays (OAs) needs to be understood. OAs provide a convenient and orderly way to utilize the fractional factorial approach to optimization. The Taguchi algorithm, as used to develop the matching circuit for the embodiment of the antenna 10 shown in FIGS. 4A and 4B, went through different circuit topologies with different capacitor and inductor values and evaluated the impedance of the entire system of the antenna 10 to arrive at a broadband match.

Figure 6:
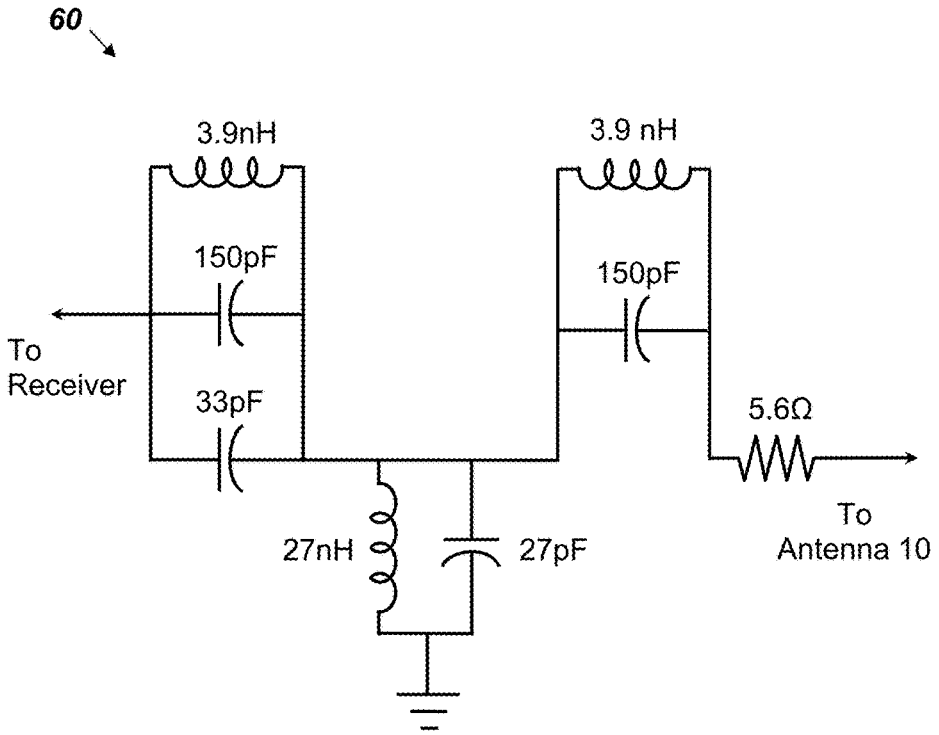
FIG. 6 is a circuit diagram.

FIG. 6 is a circuit diagram of an embodiment of a matching circuit 60 that may be used with the antenna 10. It is to be understood that the matching circuit 60 displayed in FIG. 6 is just one example of a suitable matching circuit that may be used with the antenna 10. The matching circuit 60 displayed in FIG. 6 consists of three inductors, four capacitors and one resistor. As with any antenna, AC current flows from a transceiver to the antenna 10 and vice versa (depending on full DUPLEX or Half DUPLEX functioning of the radio). As current develops in the chamber 12, electromagnetic waves begin to propagate away from the antenna 10. The matching circuit 60 shown in FIG. 6 allows the antenna 10 to operate from 130-180 MHz. Different matching circuits may be used in conjunction with the antenna 10 for each frequency band of interest. Alternatively, a single matching circuit that encompasses all desired operating frequencies may be used with the antenna 10.

Figure 7B:
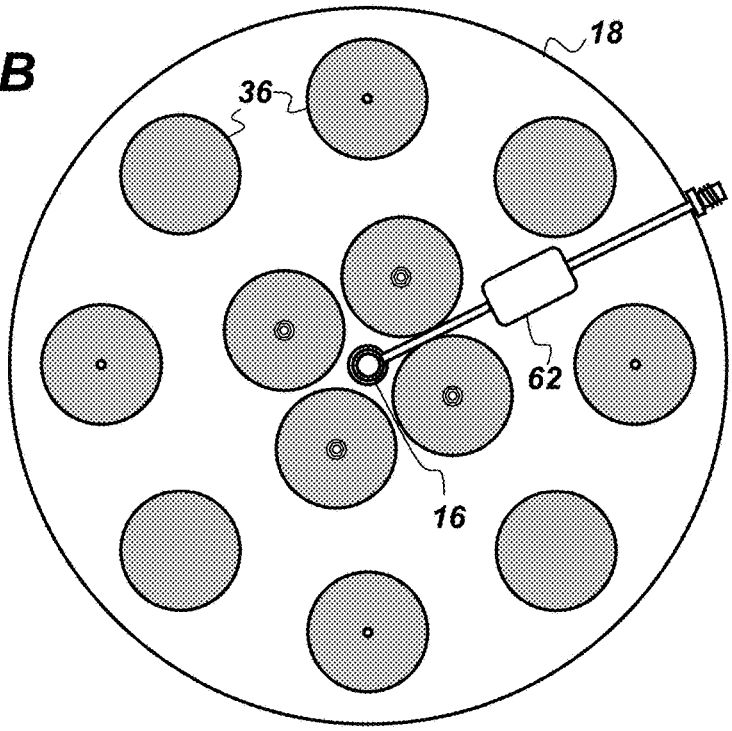
FIG. 7B is a bottom view of an embodiment of an antenna.

FIGS. 7A and 7B are a cross-sectional side view and a bottom view respectively of an embodiment of the antenna 10. In this embodiment, the second insulator 36 is comprised of a plurality of disks having a thickness of 2.54 cm (1 inch) and a diameter of 10.16 cm (4 inches). The matching circuit 62, in this embodiment, is positioned under the ground plane 18 and between the disks of the second insulator 36.

Figure 8A:
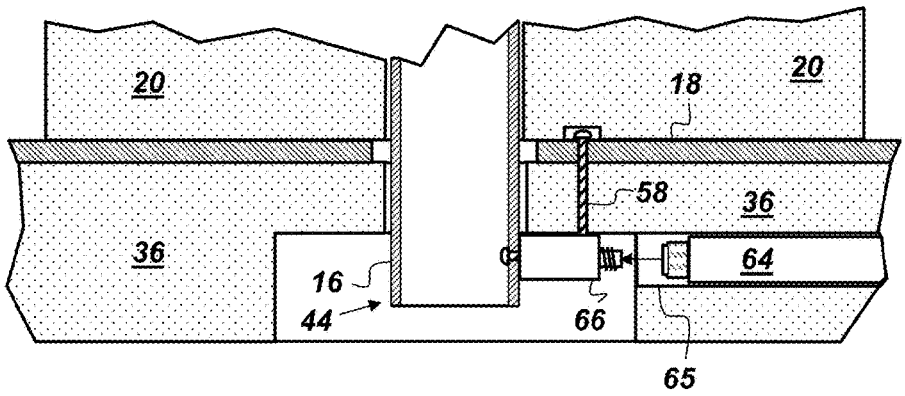
FIG. 8A is a cut-away, side view illustration of a section of an antenna.
Figure 8B:
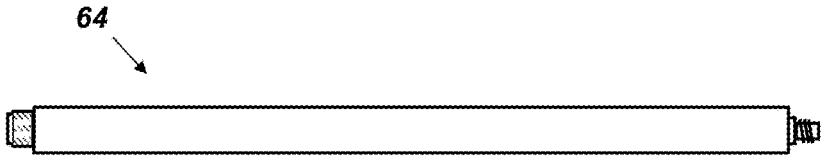
FIG. 8B is a side view illustration of a matching circuit housing.

FIG. 8A is a cross-sectional side view illustration of a section of an embodiment of the antenna 10 comprising a matching circuit 64 housed in a cylinder that is configured to fit through a slot, channel, or hole 65 in the second insulator 36 and to screw onto a connector 66. A suitable example of the connector 66 is a female Threaded Neill-Concelman (TNC) connector. The matching circuit 64 may be exchanged for different matching circuits to allow the antenna 10 to operate at different frequencies. FIG. 8B is a side view of an embodiment of the cylindrical housing of the interchangeable matching circuit 64.

Figure 9A:
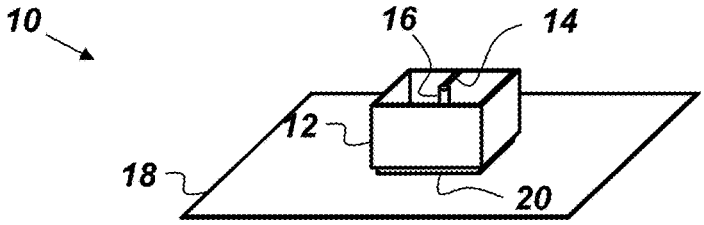
FIGS. 9A, 9B, 9C, and 9D are oblique views of different embodiments of an antenna.
Figure 9B:
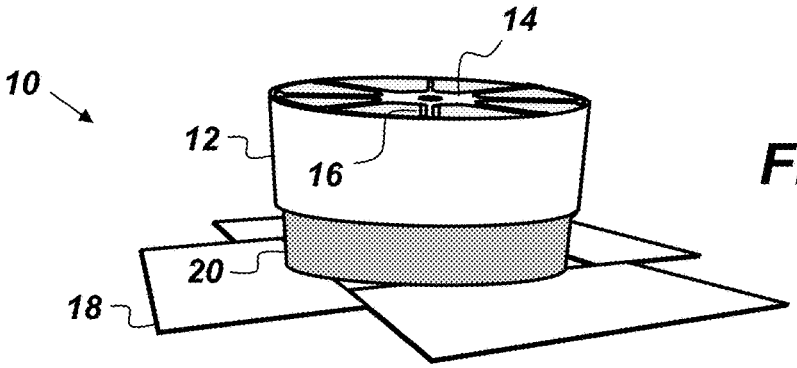
Figure 9C:
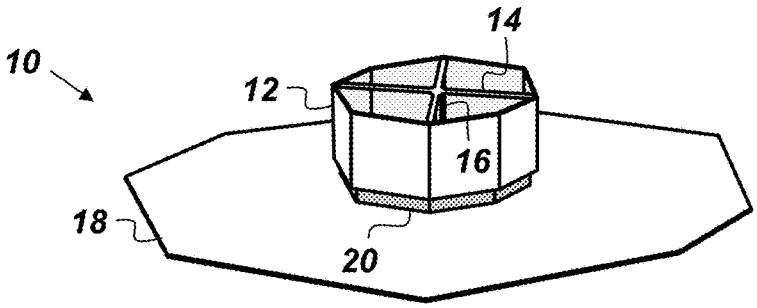
Figure 9D:
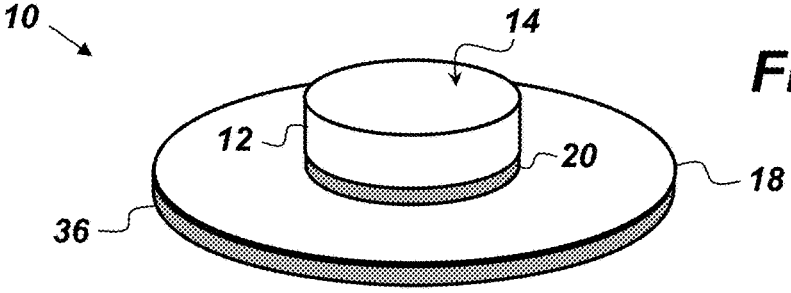

FIGS. 9A, 9B, and 9C are oblique views of different embodiments of the antenna 10. FIG. 9A illustrates an embodiment of the antenna 10 where the chamber 12 is cube-shaped and the ground plane 18 is square. FIG. 9B illustrates an embodiment of the antenna 10 where the chamber 12 is cylindrical and the ground plane 18 comprises four rectangular components. FIG. 9C illustrates an embodiment of the antenna 10 where the chamber 12 and the ground plane 18 are octagonal. FIG. 9D illustrates an embodiment of the antenna 10 where the upper end 24 of the chamber 12 is sealed with a disk-shaped shorting strap 14.

From the above description of the antenna 10, it is manifest that various techniques may be used for implementing the concepts of the antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the antenna 10 is not limited to the particular embodiments described herein, but is capable of many embodiments without departing from the scope of the claims.

We claim:

1. An antenna comprising:

a hollow conductive chamber having an upper end and a lower end, wherein the lower end is open;

a shorting strap electrically connected to the upper end;

a conductive center member running through the chamber and electrically connected to the shorting strap;

a conductive ground plane having a top surface and a bottom surface, wherein the top surface is separated from the lower end of the chamber by a gap; and a first solid insulator connected to the chamber and the top surface of the ground plane such that the first insulator fills the gap and fills the lower end and an interior portion of the chamber, wherein the hollow conductive chamber and the ground plane are fastened to the first solid insulator with non-conductive fasteners.

2. The antenna of claim 1, wherein the first solid insulator is polyoxymethylene.

3. The antenna of claim 1, wherein the first solid insulator is acetal.

4. The antenna of claim 1, wherein the first solid insulator is polytetraflouroethylene.

5. The antenna of claim 1, wherein the first solid insulator is honey.

6. The antenna of claim 1, wherein the first solid insulator is polyetherimide.

7. The antenna of claim 1, wherein the hollow, conductive chamber has a circular cross-section.

8. The antenna of claim 7, wherein the ground plane is disk-shaped and wherein a ratio of a diameter of the ground plane to a height of the antenna and a ratio of the ground plane diameter to a diameter of the conductive chamber are approximately 3:1.

9. The antenna of claim 1, wherein the hollow, conductive chamber has an octagonal cross-section.

10. The antenna of claim 1, wherein the interior portion of the chamber is dimensioned such that when the interior portion is filled with the first solid insulator, the hollow, conductive chamber resonates at a frequency in a very high frequency (VHF) range.

11. The antenna of claim 1, wherein the shorting strap is a cross comprising four arms and a center, wherein the center is electrically connected to the conductive center member and the arms are electrically connected to the upper end of the hollow, conductive chamber.

12. The antenna of claim 1, further comprising a second solid insulator connected to the bottom surface of the ground plane, wherein the second solid insulator is connected to a vehicle roof such that the ground plane is electromagnetically isolated from the roof.

13. The antenna of claim 1, wherein the center conductive member is a copper tube and the hollow, conductive chamber and the ground plane are made of brass.

14. An antenna comprising:

a hollow, conductive, cylindrical chamber having an upper end, a lower end, and a diameter d, wherein the lower end is open;

a center conductive member positioned along an axis of the chamber and electrically connected to the upper end of the chamber;

a circular, conductive ground plane having a top surface and a bottom surface and a diameter of approximately 2d, wherein the ground plane is electrically insulated from the chamber and the center member;

a first solid insulator having cylindrical shape and a diameter of approximately d, wherein the first insulator is positioned partially within, and connected to, the chamber such that it fills an interior portion of the chamber, and wherein the first insulator is connected to the top surface of the ground plane such that the top surface is separated from the lower end of the chamber by a gap, wherein the hollow conductive chamber and the ground plane are fastened to the first solid insulator with non-conductive fasteners; and a second solid insulator having a cylindrical shape and a diameter of approximately 2d, wherein the second insulator is connected to the bottom surface of the ground plane.

15. The antenna of claim 14, wherein the interior portion of the chamber is dimensioned such that when the interior portion is filled with the first insulator, the chamber resonates at a frequency in a very high frequency (VHF) range.

16. The antenna of claim 15, wherein a height of the antenna from a bottom surface of the second insulator to the upper end of the chamber does not exceed 20 centimeters and d does not exceed 61 centimeters.

17. The antenna of claim 16, wherein a first conductor of a feed line is electrically connected to the center member and a second conductor of the feed line is electrically connected to the ground plane.

18. The antenna of claim 17, wherein the first insulator is selected from the group consisting of polyoxymethylene, honey, polytetrafluoroethylene, acetal, and polyetherimide.

19. The antenna of claim 18, wherein the gap is approximately 2.5 centimeters in height.

* * * * *